US007577502B1

(12) United States Patent
Henry et al.

(10) Patent No.: US 7,577,502 B1
(45) Date of Patent: Aug. 18, 2009

(54) PROXIMITY DETECTION AND COMMUNICATION MECHANISM AND METHOD

(75) Inventors: William L. Henry, Lenexa, KS (US); Stephen V. Kilgore, Lenexa, KS (US)

(73) Assignee: J & A Industries, Inc., Kansas City, KS (US)

( * ) Notice: Subject to any disclaimer, the term of this patent is extended or adjusted under 35 U.S.C. 154(b) by 592 days.

(21) Appl. No.: 10/887,293

(22) Filed: Jul. 8, 2004

(51) Int. Cl.
*G06F 7/00* (2006.01)
*B61L 1/00* (2006.01)
*E01B 7/00* (2006.01)

(52) U.S. Cl. ..... 701/19; 701/1; 701/20; 701/207; 340/438; 340/439; 246/26; 246/218; 246/219; 246/220; 246/239; 246/314; 246/401; 246/415 R; 246/420

(58) Field of Classification Search ..... 246/26, 246/218–244, 401, 415, 314, 420; 701/19, 701/20, 1, 207; 340/438, 439
See application file for complete search history.

(56) References Cited

U.S. PATENT DOCUMENTS 5,531,408 A * 7/1996 Wechselberger ..... 246/257
5,676,337 A * 10/1997 Giras et al. ..... 246/182 A
5,806,809 A * 9/1998 Danner ..... 246/220
5,991,171 A * 11/1999 Cheng ..... 363/21.03
5,999,863 A * 12/1999 Lin ..... 701/19
6,062,514 A * 5/2000 McQuistian ..... 246/218
6,108,220 A * 8/2000 Franke ..... 363/37
6,149,106 A * 11/2000 McQuistian ..... 246/220
6,164,600 A * 12/2000 Seidl et al. ..... 246/220
6,366,041 B1 * 4/2002 Bozio et al. ..... 318/280
6,442,047 B1 * 8/2002 Cohen ..... 363/17
6,484,974 B1 * 11/2002 Franke et al. ..... 246/476
6,588,710 B1 * 7/2003 Taylor ..... 246/220
6,661,210 B2 * 12/2003 Kimball et al. ..... 323/268
2001/0054670 A1 * 12/2001 Franke ..... 246/220
2008/0179467 A1 * 7/2008 Wagner et al. ..... 246/220

* cited by examiner

*Primary Examiner*—Jack W. Keith
*Assistant Examiner*—Chuong P Nguyen
(74) *Attorney, Agent, or Firm*—Erickson, Kernell, Derusseau & Kleypas, LLC

(57) ABSTRACT

A vital proximity detection mechanism and method for reliably determining and communicating the position of a railroad switch point relative to a normal fixed track and a reverse fixed track, wherein the mechanism includes substantial component redundancy and fault-checking features and otherwise meets promulgated safety standards for vital componentry. The mechanism includes an RF transmitter and remote status indicator unit to allow for remote adjustments of proximity sensors while monitoring the effects of such adjustments.

5 Claims, 5 Drawing Sheets

PROXIMITY DETECTION AND COMMUNICATION MECHANISM AND METHOD

BACKGROUND OF THE INVENTION

1. Field of the Invention

The present invention relates to position sensing mechanisms and methods including mechanisms and systems for determining the position of members such as railroad switch points. More particularly, the present invention concerns a vital proximity detection mechanism and method for reliably determining and communicating the position, e.g., normal or reverse, of railroad switch points relative to one or more fixed tracks, wherein the mechanism includes substantial component redundancy and fault-checking features and otherwise meets promulgated safety standards for vital componentry.

2. Description of the Related Art

It is often necessary to direct trains from one track onto another. This is accomplished with a switch comprising a pair of movable rails with tapered ends or switch points. The switch points are selectively moveable between a pair of stock rails to direct the train toward one of two diverging tracks or vice versa. The switch points may referred to as "normal" and "reverse" switch points and may be described as being advanceable between a "normal" position and a "reverse" position.

When in the "normal" position a first or normal switch point is positioned against a first stock rail and a second or reverse switch points is advanced away from the second stock rail. In the "reverse" position, the reverse switch point is advanced against the second stock rail and the normal switch point is advanced away from the first stock rail. With the normal switch point in the "normal" position, the flange on the rail car wheels traveling along the first stock rail will advance inside of the normal switch point and onto the switch rail associated with the normal switch point and the flanges on the rail car wheels on the second stock rail will pass between the reverse switch point and the second stock rail and remain on the second stock rail, thereby directing the rail cars toward a first or normal section of track. With the switch in the "reverse" position, the flange on the rail car wheels on the second stock rail will travel inside of the second switch point and onto the switch rail associated with reverse switch point while the rail car wheels on the first stock rail will pass between the first switch point and the first stock rail and remain on the first stock rail, thereby directing the rail cars toward a second or reverse section of track.

It is extremely important that the switch points be aligned with the proper track within prescribed safety tolerances or the train may immediately derail. Furthermore, it is extremely important that the actual and true position, whether normal or reverse, of the switch points be determined and communicated because the two fixed tracks may require very different maximum safe travel speeds to avoid subsequent derailment. Thus, for example, a train may expect the switch point to be in a normal position and therefore to proceed onto the main track, only to discover that the prior art switch point position detection mechanism is malfunctioning and the train is, in fact, moving onto the branch track at an unsafe speed which may cause it to derail.

It is generally known to use a switch circuit controller for determining the position of the switch point. These prior art mechanisms typically meet the standards or specifications promulgated by the American Railway Engineering and Maintenance-of-Way Association (AREMA) for "vital" components or devices, i.e., components or devices whose function affects the safety of the train, such as certain signal lights, relays, switches, and circuits.

However, these prior art switch point position detection mechanisms suffer from a number of other problems and disadvantages that can cause a loss of detection or an inaccurate indication of switch point position, the consequences of which include increased maintenance costs and increased risks of train delays or derailments. These problems and disadvantages include, for example, loose or worn connecting rod linkages; loose or worn bolts or screws that fasten the prior art controller box to the ties or plates; worn bearings, connections, or contacts in the prior art controller box; improper adjustment of cams, contacts, and linkages; shorted, open, or crossed wirings due to mechanical damage, rodent damage, and various other causes; running rails; and labor-intensive installation maintenance, inspection, and adjustment requirements.

Due to the above-identified and other problems and disadvantages in the prior art, a need exists for an improved mechanism or method for more reliably determining and communicating the position and alignment of a railroad switch point.

SUMMARY OF THE INVENTION

The present invention overcomes the above-described and other problems and disadvantages in the prior art by providing a vital proximity detection mechanism and method for use in determining the position, i.e., normal or reverse, of railroad switch points relative to first and second stock rails or fixed tracks, and providing a output signals indicative of the switch point positions which may be used to communicate the determined position to a railroad signaling device or the like. The mechanism uses two substantially separate circuits to allow for cross-checking and redundancy to ensure proper and reliable operation. By default, the critical signal device will be energized only if all criteria are met. In addition, the output signals which are produced by the circuits are electrically isolated from the power source to prevent a false output signal if the circuits are damaged. The mechanism is designed to meet applicable AREMA safety standards and specifications for vital componentry and devices.

In a preferred first embodiment, the mechanism generally comprises a normal circuit, a reverse circuit, an RF transmitter, and a remote status indicator unit. The normal circuit includes first and second proximity sensors; first and second microprocessors; first and second power supplies; and first and second diodes connected to a set of output terminals to which a relay or signal controlling device may be connected to utilize an output signal generated by the circuit in controlling a signalling device. Similarly, the reverse circuit includes third and fourth proximity sensors; the first and second microprocessors; third and fourth power supplies; and third and fourth diodes connected to a second set of output terminals to which a relay or signal controlling device may be connected. Each of the circuits may include a plurality of status-indicating LEDs.

The first and second proximity sensors independently generate first and second electronic sensor signals indicative of the proximity of the switch points to the normal position or first alignment, and the third and fourth proximity sensors independently generate third and fourth electronic sensor signals indicative of the proximity of the switch points to the reverse position or second alignment. The present invention's use of two proximity sensors for each position provides operational redundancy and enhanced reliability, as discussed below in greater detail. The output of each of the proximity sensors is applied to the input of each of the microprocessors.

The microprocessors generate control signals based on input from the proximity sensors, and also periodically test the proximity sensors and the power supplies to ensure continued proper operation. Each microprocessor receives and independently compares the sensor signals to confirm consistency. If each microprocessor independently confirms such consistency, the microprocessors compare their independently-derived results with each other to further confirm consistency. The microprocessors send control signals to an associated pair of the power supplies if selected conditions are met including agreement between both microprocessors with regard to the position detected by each proximity sensor and none of the tests of the proximity sensors or power supplies indicates a defect.

The first and second power supplies provide AC-coupled and isolated power to the first output terminal under direction of, respectively, the first and second microprocessors. Similarly, the third and fourth power supplies provide AC-coupled and isolated power to the second set of output terminals under direction of, respectively, the first and second microprocessors.

The diodes are connected to an output conductor for each of the power supplies between the power supply and the associated terminal. The diodes prevent electronic feedback between the first and second power supplies or the third and fourth power supplies via the associated output conductors. The first output terminals provide an output signal for use in controlling the delivery of power to the normal signal device, while the second output terminals provides an output signal for use in controlling the delivery of power to the reverse signal device.

The first plurality of status-indicating LEDs is associated with and provides status information for aspects of the normal circuit, while the second plurality of status-indicating LEDs is associated with and provides status information for the same aspects of the reverse circuit.

The RF transmitter receives input from the microprocessors regarding the statuses of the proximity sensors and relays. This information is transmitted by the RF transmitter via an RF signal. The remote status indicator unit facilitates testing the mechanism by receiving the RF signal and visually communicating these statuses. This allows a technician to position him- or herself at the location of the proximity sensor, which may be substantially removed from the microprocessors, and make adjustments thereto while monitoring the results of those adjustments as determined by the microprocessors.

Thus, it will be appreciated that the mechanism and method of the present invention provide a number of substantial advantages over the prior art and is designed to meet applicable AREMA safety standards and specifications for vital components and devices. Redundant proximity sensors, microprocessors, and power supplies are provided for each position to ensure reliable operation. The failure of any one of these components results in immediate detection of improper circuit operating conditions and corresponding action.

These and other important features of the present invention are more fully described in the section titled DETAILED DESCRIPTION OF A PREFERRED EMBODIMENT, below.

BRIEF DESCRIPTION OF THE DRAWINGS

A preferred embodiment of the present invention is described in detail below with reference to the attached drawing figures, wherein.

DETAILED DESCRIPTION OF A PREFERRED EMBODIMENT

Figure 1:
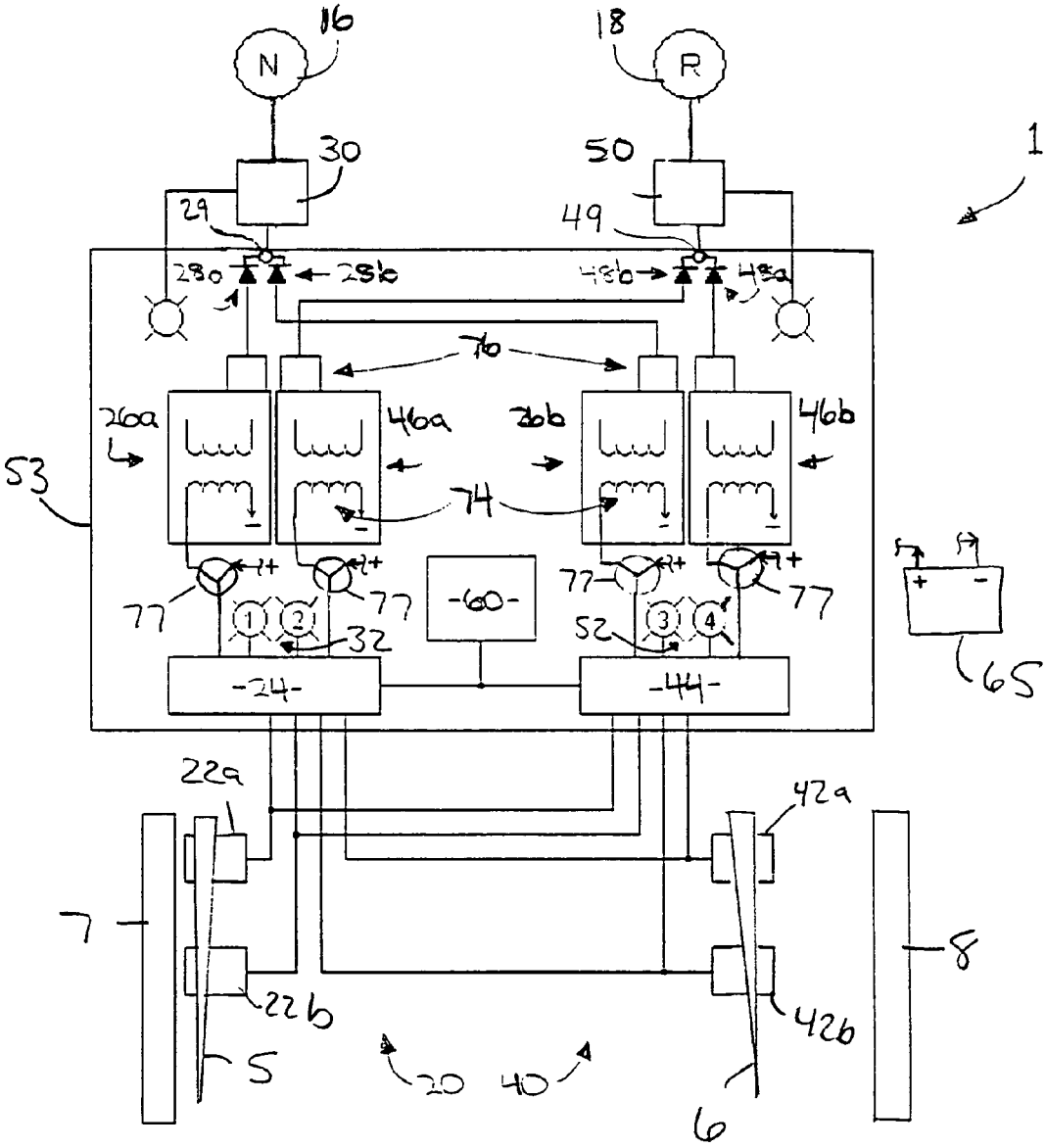
FIG. 1 is a block diagram showing major components of a preferred first embodiment of the vital proximity detection mechanism of the present invention.

With reference to the figures, a vital proximity detection (VPD) mechanism 1 and method is herein described, shown, and otherwise disclosed in accordance with a preferred embodiment of the present invention. The mechanism 1, a preferred embodiment of which is shown schematically in FIG. 1, is an electronic solid-state device for determining a proximity and alignment of a first part or member relative to a second part or member within a tolerance required by the particular application. In one contemplated application, as generally shown in FIG. 2, the mechanism 1 is adapted for use in determining the position of a normal and reverse switch points 5 and 6 relative to first and second stock rails 7 and 8 and more specifically for providing output signals indicative of whether the normal switch point 5 is in the normal position relative to the first stock rail 7, as shown in FIG. 2, or whether the reverse switch point 6 is in the reverse position relative to the second stock rail 8.

The switch points 5 and 6 are selectively moveable between the normal position and the reverse position by an actuator or driver not shown that generally comprises a motor driven or hand operated mechanical linkage. The switch points 5 and 6 are typically connected together by a connector 11 preferably extending between the switch points 5 and 6 near their tips to maintain the desired spacing of the switch points 5 and 6.

The mechanism 1 is adapted for communicating the output signals to railroad signal systems which utilize the output signals to control signal devices. For example, signal controllers such as relays 30 and 50, which control signaling devices such as lamps 16 and 18, may be hard wired to the mechanism 1, or the output signals may be connected to the signal controllers or other control systems using wireless technologies.

Figure 2:
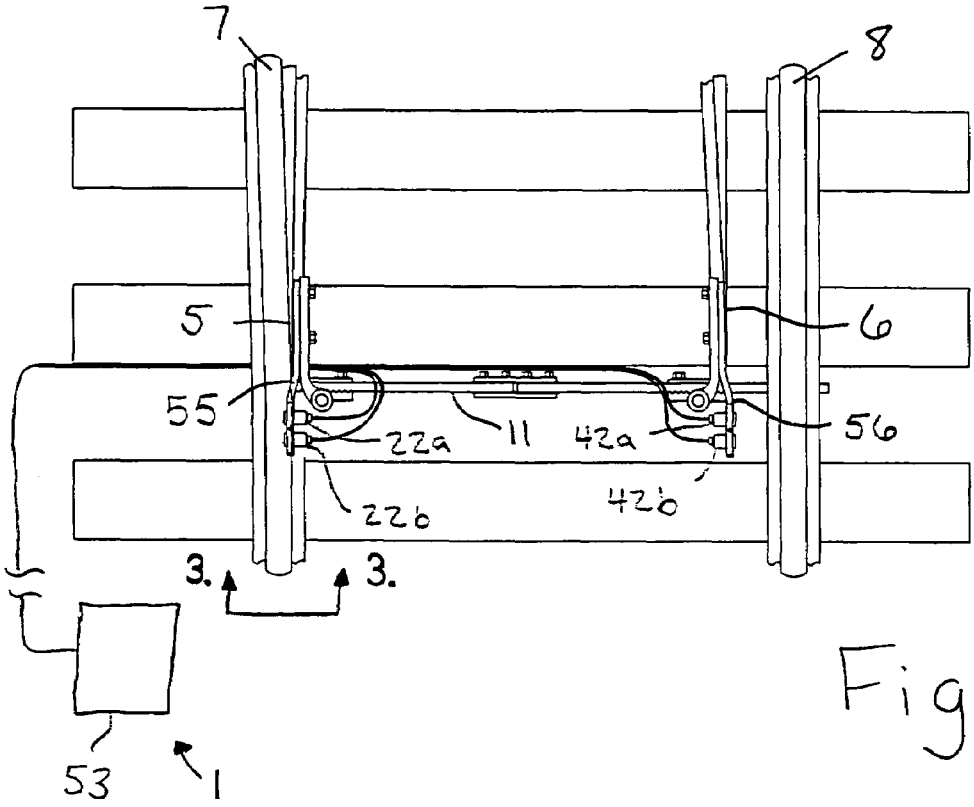
FIG. 2 is a fragmentary top plan view showing placement of first, second, third and fourth proximity sensor components of the present invention relative to rail switch points.
Figure 3:
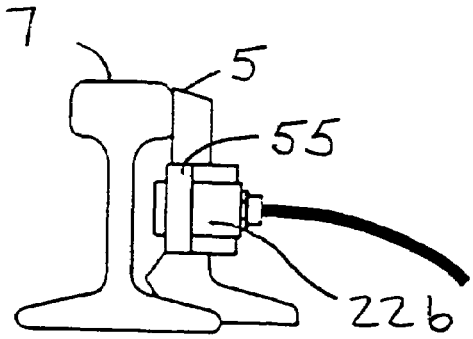
FIG. 3 is a fragmentary cross-sectional elevation view taken along line 3-3 of FIG. 2.

As used herein, reference to the normal switch point 5 being positioned in the normal position indicates that the normal switch point 5 is either positioned against the first stock rail 7, as shown in FIGS. 2 and 3, or the normal switch point 5 is spaced from the first stock rail 7 no more than within a normal tolerance which is a distance recognized a safe for permitting passage of a train across the normal switch point 5 when the switch point 5 is to be used to direct a train down an associated normal track. A standard normal tolerance on track governed by a signal system is a quarter of an inch. Reference to the reverse switch point 6 being positioned in the reverse position indicates that the reverse switch point 6 is either positioned against the second stock rail 8 or the reverse switch point 6 is spaced from the second stock rail 8 no more than within a reverse tolerance which is a distance recognized a safe for permitting passage of a train across the reverse switch point 6 when the switch point 6 is to be used to direct a train down an associated reverse or switched track. A standard reverse tolerance on track governed by a signalsystem is also a quarter of an inch. Referring to FIG. 2, the reverse switch point 6 is shown as being positioned out of the reverse position. It is to be understood that as used herein, reference to a pair of members being positioned in any specified position or alignment is generally intended to indicate that the members are positioned in the specified alignment or the deviation of the spacing of the members from the specified alignment is within an accepted range or tolerance.

The mechanism 1 uses components selected, configured and programmed to provide substantially fail-safe operation and which may be referred to as vital. The components have reduced maintenance requirements in comparison to prior art mechanisms that use mechanical switch point controller mechanisms or non-vital PLCs, monitors, and sensors that can fail or provide false positive readings in unsafe states.

The mechanism 1 uses two substantially separate circuits to allow for cross-checking and redundancy to ensure proper and reliable operation. By default, the critical relays 30 and 50 will be energized only if all of the specified criteria or conditions are met. The mechanism 1 is designed to meet applicable AREMA safety standards and specifications for vital componentry and devices.

Figure 4:
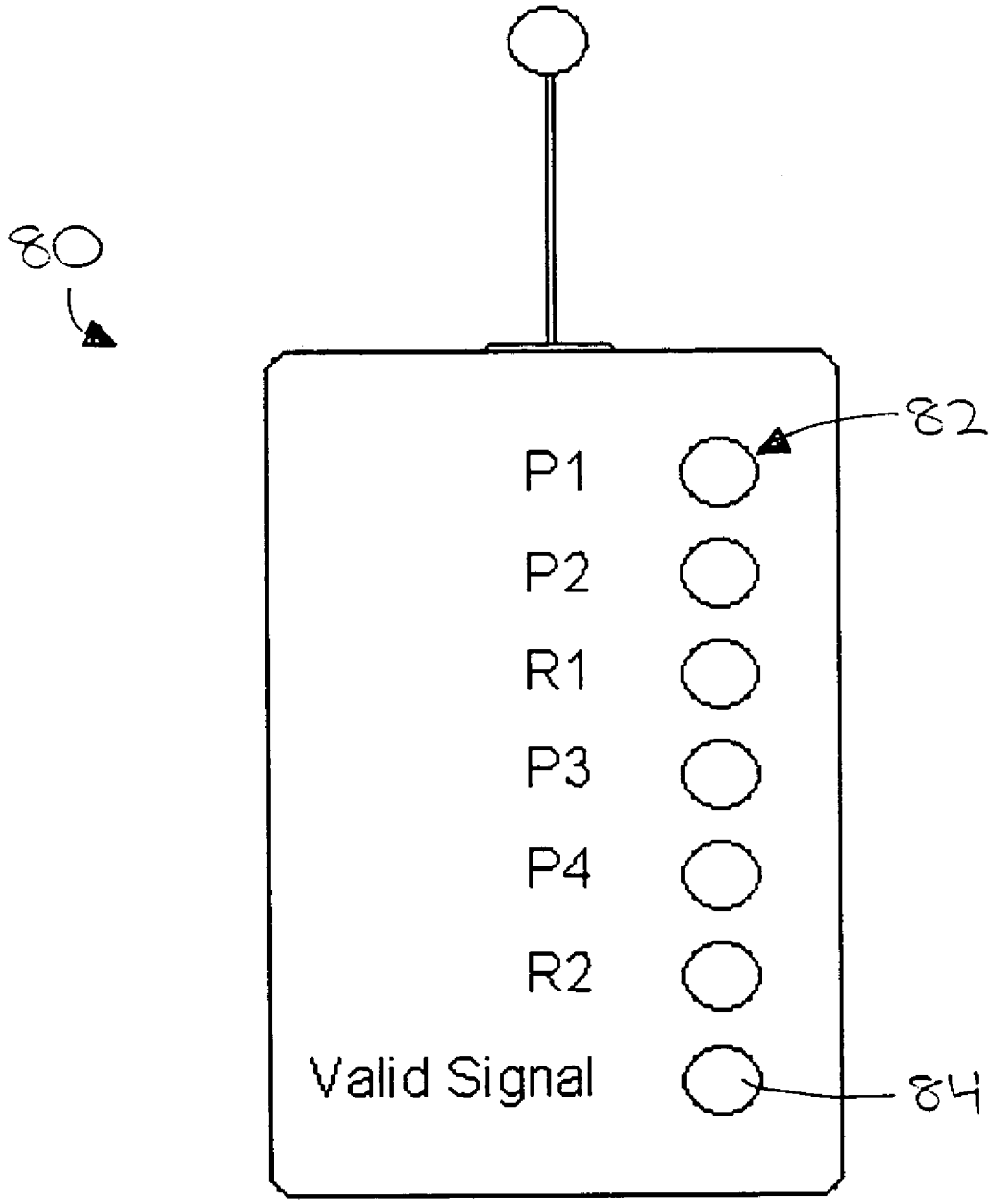
FIG. 4 is a front view of a remote status indicator unit for use in testing the mechanism of FIG. 1.

Referring particularly to FIG. 1, a preferred first embodiment of the mechanism 1 is shown as comprising a normal circuit 20, a reverse circuit 40, an RF transmitter 60, and a remote status indicator unit 80 (shown in FIG. 4). The normal circuit 20 includes first and second proximity sensors 22*a*, 22*b*; first and second microprocessors 24, 44; first and second power supplies 26*a*, 26*b*; and first and second diodes 28*a*, 28*b* connected to a first or normal set of output terminals 29. As discussed previously, the normal set of output terminals 29 are adapted for connection thereto of a signal control device, such as first relay 30 which functions to supply requirements of the signal device 16 if a normal output signal is received at the normal output terminal 29. A first plurality of status-indicating LEDs 32 is also included in the normal circuit 20. The reverse circuit 40 includes third and fourth proximity sensors 42*a*, 42*b*; the first and second microprocessors 24,44; third and fourth power supplies 46*a*, 46*b*; and third and fourth diodes 48*a*, 48*b* connected to a reverse output terminal 49. The reverse output terminal 49 is adapted for connection thereto of a signal control device, such as second relay 50 which functions to supply requirements of the signal device 18 if a reverse output signal is received at the reverse set of output terminals 49. A second plurality of status-indicating LEDs 52 is also included in the normal circuit 20.

The normal and reverse circuits 20 and 40, including microprocessors 24,44, first and second power supplies 26*a* and 26*b*, first and second diodes 28*a* and 28*b* and terminals 29 and 49 are mounted on a main circuit board which may be mounted within a protective, sealed enclosure 53 in a component rack or in a separate enclosure provided by the end user. The main circuit board operates in an AREMA defined Class C environment and should therefore be designed to meet Class C requirements. Similarly, the microprocessors 24,44 are preferably designed to meet standards for extreme service applications, particularly with regard to electrical noise.

As shown in FIGS. 2 and 3, the proximity sensors 22*a* and 22*b* are mounted on a first lug, bar or bracket 55 connected to the switch point 5 with the sensors 22*a* and 22*b* facing the first stock rail 7. The first and second sensors 22*a* and 22*b* are attached to the bracket 55 by threading into a sleeve which slides to allow adjustment and is mechanically locked in position when adjustment is complete relative to the bracket 55 and switch point 5. Similarly proximity sensors 42*a* and 42*b* are adjustably mounted on second bracket 56, and face the second stock rail 8.

The proximity sensors 22*a*, 22*b*, 42*a* and 42*b* each independently generate an electronic signal indicative of the proximity of the associated switch point 5 or 6 to the stock rails 7 and 8. More specifically, the first and second proximity sensors 22*a*,22*b* generate first and second electronic sensor signals indicative of the proximity or position of the normal switch point 5 relative to the first stock rail 7. Similarly, the third and fourth proximity sensors 42*a*,42*b* generate third and fourth electronic sensor signals indicative of the proximity or position of the reverses witch point 6 relative to the second stock rail 8.

Proximity sensors suitable for use in the present invention are available, for example, from Turck, Inc., which rely on an inductive effect to determine the closeness of metals and therefore do not require that electric current be applied to the rails. The inductive type proximity sensors generate a signal which is generally proportional to the distance of the proximity sensor from the associated rail within the range or tolerance to be detected.

As noted previously, the position of the proximity sensors 22*a*, 22*b*, 42*a* and 42*b* relative to the respective switch points 5 and 6 may be adjusted to generally calibrate the amperage of the proximity sensor output signal to the distance between the associated switch point and stock rail. It should be noted that the signal generated by the preferred inductive sensor does not drop below a minimum prescribed preset amperage unless the sensor is not functioning. In addition, above a spacing which exceeds the tolerated range or spacing to be detected, the increase in the output amperage may exceed a proportional increase.

The first, second, third and fourth proximity sensors 22*a*, 22*b*, 42*a* and 42*b* generate first, second, third and fourth output signals or sensor signals which are transmitted to both the first and second microprocessors 24 and 44. The microprocessors 24 and 44 receive and analyze the sensor signals and determine whether the sensor signal indicates that the associated switch point 5 or 6 is in the desired position. For example, if amperage of the first sensor signal received from the first proximity sensor 22*a* is equal to or less than the amperage corresponding to the maximum tolerated spacing, then the first and second microprocessors 24 and 44 make a determination that the first sensor signal indicates that switch point 5 is in the normal position. If the first sensor signal exceeds amperage corresponding to the maximum tolerated spacing, then the first and second microprocessors 24 and 44 make a determination that the first sensor signal indicates that switch point 5 is not in the normal position. In addition, if no signal is received from the first proximity sensor 22*a* the microprocessors 24,44 determine that the absence of a signal is treated by the microprocessor as a first sensor signal indicating that the switch point 5 is not in the normal position.

The present invention's use of two proximity sensors to determine whether a switch point is in the position to be detected provides operational redundancy and enhanced reliability, as discussed below in greater detail. The output of each of the proximity sensors 22*a*,22*b*,42*a*,42*b* is applied to the input of each of the microprocessors 24,44, preferably using approved AAR or Wago terminals. The input circuits from the proximity sensors 22*a*,22*b*,42*a*,42*b* are isolated from the rail and are protected by automatically resetting fuses. The proximity sensors 22*a*,22*b*,42*a*,42*b* operate in an AREMA defined Class A track-side environment and should therefore be designed or selected to meet Class A requirements.

The microprocessors 24 and 44 are each programmed to separately generate control signals or cause control signals to be generated through the power supplies 26*a*, 26*b*, 46*a* and 46*b* and accessible through the first and second terminals 29 and 49 if selected conditions are satisfied. Generation of a control signal accessible at the first terminal 29 is indicative of a determination by the microprocessors 24,44 that the first and second sensor signals indicate the normal switch point 5 is in the normal position, that the third and fourth sensor signals do not indicate otherwise, and that all of the proximity sensors 22*a*,22*b*,22*c*,22*d* and both of the microprocessors 24,44 are functioning properly. Similarly generation of a control signal accessible at the second set of terminals 49 is indicative of a determination by the microprocessors 24,44 that the third and fourth sensor signals indicate the reverse switch point 6 is in the reverse, that the first and second sensor signals do not indicate otherwise, and that all of the proximity sensors 22*a*,22*b*,42*a*,42*b* power supply 26*a*,26*b*,46*a*,46*b* and both of the microprocessors 24,44 have been tested and are functioning properly. The output signals preferably comprise DC signals adapted for activating the relays 30 and 50 to supply the requirements of the signaling devices 16 and 18 when the selected conditions are met.

The microprocessors 24,44 periodically and alternatingly test the proximity sensors 22*a*,22*b*,42*a*,42*b* to determine if they are functioning properly by opening and closing an analog switch contact associated with the sensor and inducing short and open circuit conditions in order to determine whether each proximity sensor 22*a*,22*b*,42*a*,42*b* is within its acceptable operating range. The microprocessors 24,44 periodically and alternatingly test the power supplies 26*a*,26*b*, 46*a*,46*b* to determine if they are functioning properly by measuring an output voltage of the power supply 26*a*,26*b*, 46*a*,46*b* when it is on, and ensuring that the output voltage drops to zero when the power supply 26*a*,26*b*,46*a*,46*b* is turned off.

In the preferred first embodiment, each microprocessor 24 and 44 is programmed to receive each of the sensor signals from each of the proximity sensors 22*a*,22*b*,42*a* and 42*b* and independently determines whether the first and second sensor signals indicate that the normal switch point 5 is in the normal position and whether the third and fourth sensor signals indicate that the reverse switch point 6 is in the reverse position. Each microprocessor 24,44 then independently compares the sensor signals to confirm consistency. The first sensor signal should not, for example, indicate a normal position while the third sensor signal indicates a reverse position. If each microprocessor 24,44 independently confirms such consistency, the microprocessors 24,44 then compare their independently-derived results with each other to further confirm consistency. The first microprocessor 24 should not, for example, find that the sensor signals indicate a reverse position while the second microprocessor 44 finds that the sensor signals indicate a normal position.

For the microprocessors 24 and 44 to cause an output control signal to be provided at the first terminal set 29 for use in indicating that the normal switch point 5 is in the normal position, the following conditions or first set of conditions may be required to be satisfied: the first and second microprocessors 24,44 should agree that all of the proximity sensors 22*a*,22*b*,42*a*,42*b* and all of the power supplies 26*a*,26*b*, 46*a*,46*b* are functioning properly; the first and second microprocessors 24,44 should agree that the first and second sensor signals both indicate that the normal switch point 5 is in the normal position and that neither the third or fourth sensor signals indicate that the reverse switch point 6 is in the reverse position. For the microprocessors 24,44 to cause an output control signal to be provided at the second terminal 49 for use in indicating that the reverse switch point 6 is in the normal position, the following similar conditions or first set of conditions may be required to be satisfied: the first and second microprocessors 24,44 should agree that all of the proximity sensors 22*a*,22*b*,42*a*,42*b* and all of the power supplies 26*a*,26*b*,46*a*,46*b* are functioning properly; the first and second microprocessors 24,44 should agree that the second and third sensor signals both indicate that the reverse switch point 6 is in the normal position and that neither the first or second sensor signals indicate that the normal switch point 5 is in the normal position. Assuming the required sets of conditions are met (both cannot be met simultaneously), the microprocessors 24,44 cause output signals to be generated and made accessible at the terminal sets 29 or 49 through the power supplies 26*a*, 26*b*, 46*a* and 46*b*.

The power supplies 26*a*,26*b*,46*a*,46*b* are used to provide electrically isolated power or output signals to the terminal sets 29 and 49 in response to action by the microprocessors 24,44. In the embodiment shown, the output signals are supplied to relays 30 and 50 connected to the terminal sets 29 and 49. More specifically, the first and second power supplies 26*a*,26*b* provide AC-coupled and DC isolated power to the first terminal set 29 and relay 30 under direction of, respectively, the first and second microprocessors 24,44. Similarly, the third and fourth power supplies 46*a*,46*b* provide AC-coupled and isolated power to the second terminal 49 and second relay 50 also under direction of, respectively, the first and second microprocessors 24,44.

The power source for providing the output signals and operating the mechanism 1 is preferably supplied from batteries 65 positioned near the mechanism 1. Each power supply 26*a*,26*b*,46*a*,46*b* is a DC-to-DC converter design that includes a transformer 74 and a bridge rectifier 76. Normally open transistors 77 are preferably electrically connected between the batteries 65 and each transformer 74 and controlled by a pilot signal from an associated microprocessor 24,44.

Upon satisfaction of the conditions to cause the first and second processors 24,44 to generate output signals indicating that the normal switch point 5 is in the normal position, the processors 24,44 cause first and second transistors 77 to rapidly close and open which results in a pulsing of the supply of DC power from the batteries 65 to first and second transformers 74 so that the resulting signal appears to the first and second transformers 74 as an AC signal. The first and second transistors 77 are closed and opened at a frequency that can be utilized by the transformers 74, which in the preferred embodiment is approximately 50 kHz. Passage of the rapidly changing DC signal through an input coil of the transformers 74 causes an AC voltage to be produced at the output of the transformers 74. Bridge rectifiers 76 connected to the output of the transformers 74 convert the AC voltage produced by the transformers 74 back to non-pulsing or non-rapidly changing DC power signals which can be used to power the relay 30 through terminal 29.

The third and fourth power supplies 46*a* and 46*b* function in the same manner as first and second power supplies 26*a* and 26*b* to provide an electrically isolated DC power signal at the terminal 49 indicating that the reverse switch point 6 is in the reverse position. The resulting non-pulsing or non-rapidly changing DC power signals can be used to power the relay 50.

Reference to the output DC power signal being electrically isolated is intended to indicate that there is no physical connection between the trackside batteries 65 and the output side of the power supplies 26*a*,26*b*,46*a*,46*b*. Any short or open in the circuit will prevent generation of an output signal at the first and second terminal sets 29 and 49 causing any attached signaling devices or relays 30,50 to switch off. Similarly, if the microprocessor 24,44 stops operating, the power supply 26*a*,26*b*,46*a*,46*b* will not be pulsed, thereby also preventing the generation of an output signal at the terminal sets 29 and 49, causing any attached signaling device or relay 30,50 to switch off. The preferred power range for component operability is approximately between 10 VDC and 16 VDC. The paired power supplies 26*a*,26*b* can provide the DC output signal either independently or together and the paired power supplies 46*a*,46*b* can provide the DC output signal either independently or together. It will be appreciated that the present invention's use of dual, redundant, AC-coupled, electrically isolated power supplies further ensures reliable operation of the mechanism 10. For example, if all of the conditions required for generating an output signal indicating the normal switch point 5 is in the normal position have been satisfied, the failure of one of the redundant power supplies 26*a* or 26*b* should not prevent the output signal from being communicated to the terminal 29 for use in communicating that the normal switch point 5 is in the normal position.

With regard to electrical protection, it should also be noted that surge protection will typically be provided by the railroad signal department. Furthermore, vital system inputs are substantially immune to false energization by alternating current of up to at least 500V. The mechanism 10 is not susceptible to electro-static discharge (ESD) because diodes and mosorbs protect the input and output circuits.

The diodes 28*a*,28*b*,48*a*,48*b* prevent electronic feedback between the microprocessors 24,44 and the relays 30,50. The relays 30,50 provide power to the signaling devices 16,18. More specifically, the first relay 30 provides power to the normal signal device 16, while the second relay 50 supplies the requirements of the signaling device 18.

The first and second pluralities of status-indicating LEDs 32,52 are mounted to the main circuit board within the enclosure 53. The first plurality of LEDs 32 is associated with and provides status information for aspects of the normal circuit 20, including, for example, the statuses of the first and second proximity sensors 22*a*,22*b* and the status of the first relay 30, and the second plurality of LEDs 52 is associated with and provides status information for the same aspects of the reverse circuit 40. Each of the various LEDs preferably provides information concerning the nature of a failure: a steadily lit LED, for example, may indicate proper operation; a series of long and short flashing codes may indicate a specific proximity sensor failure or power supply failure; and an unlit LED may indicate microprocessor failure or loss of power to the mechanism 10.

The RF transmitter 60 receives input from the microprocessors 24,44 regarding the statuses of the proximity sensors 22*a*,22*b*,42*a*,42*b* and the relays 30,50, and transmits this information via an RF signal.

Referring also to FIG. 4, the remote status indicator (RSI) unit 80 facilitates testing the mechanism 10 by receiving the RF signal transmitted by the RF transmitter 60 and visually communicating the statuses of the proximity sensors 22*a*,2*b*, 42*a*,42*b* and the relays 30,50. This allows a technician to position him- or herself at the physical location of the proximity sensor 22*a*,22*b*,42*a*,42*b*, which may be substantially removed from the microprocessors 24,44 within the enclosure 53, and make adjustments thereto while monitoring the results of those adjustments as determined by the microprocessors 24,44. The contemplated range of the RSI unit 80 is approximately between 500 feet and 2000 feet with a likely range of 1000 feet.

The RSI unit 80 includes an LED 82 or other indicator for communicating the status of each proximity sensor 22*a*,22*b*, 42*a*,42*b* and relay 30,50, and further includes an LED 84 for indicating when the RSI unit 80 is within reception range of the RF transmitter 60. Where there are multiple instances of the mechanism 1 within range of the RSI unit 80, a calibration mode switch may be provided to allow for selecting the desired mechanism 1 for adjustment or testing, thereby preventing false readings from the non-selected mechanisms.

In keeping with the present invention's goal of increased operational reliability, a detailed manual for installation, adjustment, troubleshooting, and specifications will preferably be provided with each mechanism 1. Each mechanism 1 will preferably have a serial number and will be tested and certified by the manufacturer to be operating properly. Also, a description of the methodologies in design, development, safety assurance, reliability, and maintainability will preferably be compiled.

Figure 5:
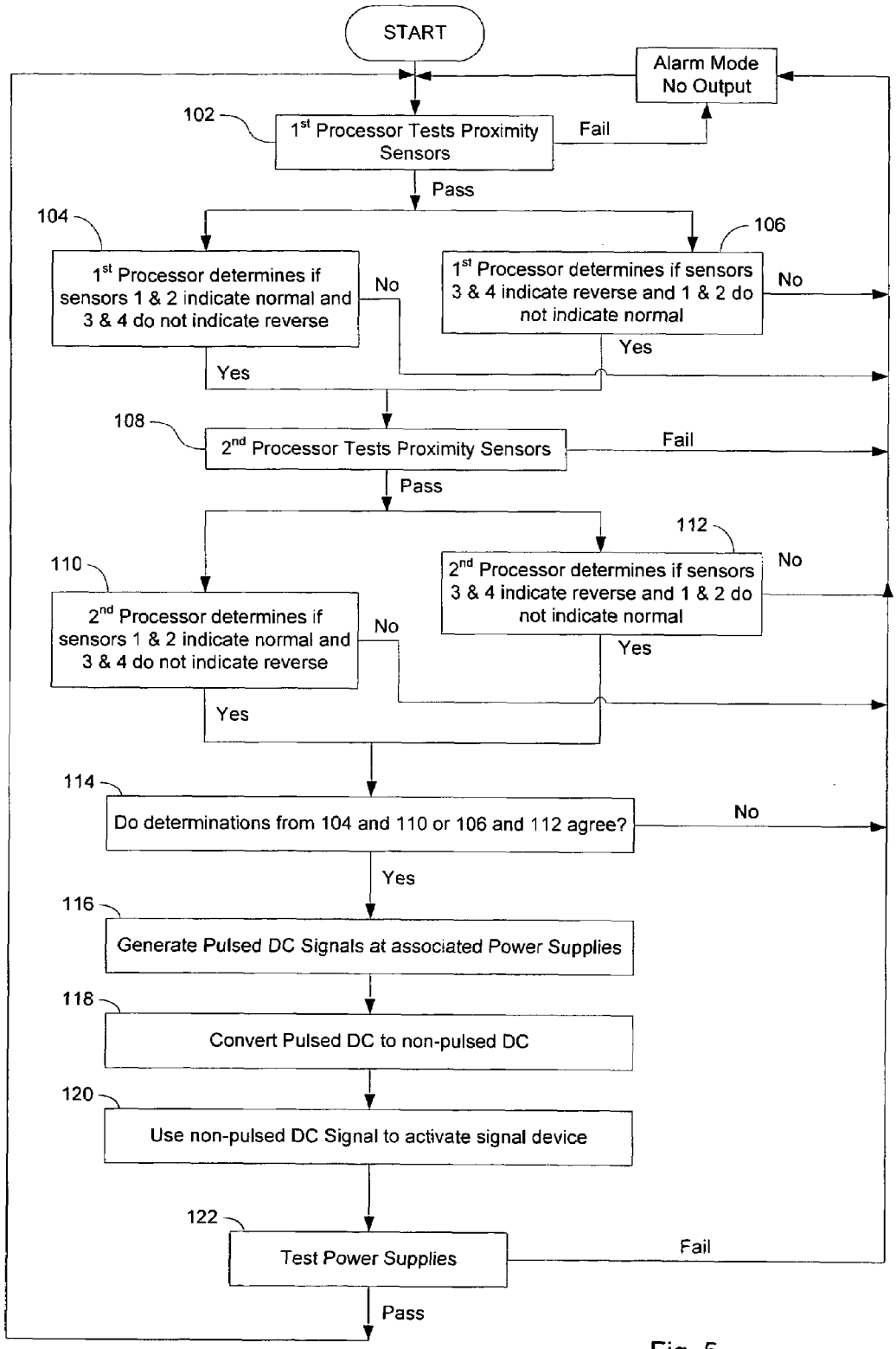
FIG. 5 is a flowchart showing steps involved in operation of the mechanism of FIG. 1.

In exemplary use and operation, the mechanism 1 may function as described below with reference to FIG. 5. Use of the mechanism 1 will be made with reference to the normal switch point 5 initially positioned in the normal position as shown in FIG. 2. Upon turning on the mechanism (using a switch not shown), and at the beginning of a sensing routine, as depicted at 100 of FIG. 5, the first microprocessor 24, tests all four proximity sensors 22*a*,22*b*,42*a*,42*b*, at step 102, as described above to confirm proper functioning. Throughout the process if the results of an evaluation or analysis indicates that some aspect of the mechanism 1 is not functioning properly, an alarm mode will be activated and the processors 24, 44 will return to the start of the routine at 100 and repeat the sensing routine.

If first microprocessor 24 determines at 102 that all four proximity sensors are functioning properly, the first microprocessor receives sensor signals from all four sensors 22*a*, 22*b*,42*a*,42*b* at 104 and determines whether a first condition is met in that the first and second sensor signals both indicate that the normal switch point 5 is in the normal position and neither the third or fourth sensor signals indicates that the reverse switch point 6 is in the reverse position. Approximately simultaneously, the first microprocessor determines, at 106, whether an alternate first condition is met in that the third and fourth sensor signals both indicate that the reverse switch point 6 is in the reverse position and neither the first and second sensor signals indicates that the normal switch point 5 is in the normal position.

Upon determination by the first microprocessor 24 that the first condition is met, the first microprocessor signals the second microprocessor which then performs the step 108 of testing all four proximity sensors 22*a*,22*b*,42*a*,42*b*, as described above to confirm proper functioning. If the test indicates proper functioning of all of the sensors, the second microprocessor 44 receives signals from all four proximity sensors 22*a*,22*b*,42*a*,42*b* at 110 and 112 and at 110 determines whether the first and second sensor signals both indicate the normal switch point 5 is in the normal position and neither the third and fourth sensor signals indicate the reverse switch point 6 is in the reverse position and at 114 confirms whether the determinations by the first and second microprocessors 24,44 are in agreement. If at step 106 the first processor 24 determined that third and fourth sensors 42*a* and 42*b* both indicated a reverse position and neither sensors 1 and 2 indicated a normal position, then at step 112 the second processor 44 would attempt to independently confirm that determination of step 106.

If both microprocessors 24,44 confirm that the first and second sensor signals both indicate the normal switch point 5 is in the normal position and neither the third and fourth sensor signals indicate the reverse switch point 6 is in the reverse position, the first and second microprocessors 24,44 cause the first and second transistors to produce a pulsing DC signal at the first and second transformers 74 of first and second power supplies 26*a* and 26*b* at step 116. The pulsed DC signals are then converted to non-pulsed DC signals by the first and second power supplies 26*a* and 26*b* in the manner described above at step 118. The non-pulsed DC signal or output signal is then used by a relay 30 or the like for activating a signal device 16 indicating the normal switch point 5 is in the normal position at step 120. The first and second microprocessors 24,44 may then test the power supplies 26*a*,26*b*, 46*a* and 46*b* at 122 to confirm that they are functioning properly and not generating false output signals.

The sensing routine is then repeated beginning again with the testing of the proximity sensors 22*a*,22*b*,42*a*,42*b* by the first microprocessor 24 at step 102. The mechanism 1 will continue to generate a normal output signal indicating the normal switch point 5 is in the normal position until a negative result is obtained in the routine described above. If the negative result was obtained due to a temporary condition, the normal output signal will be generated once the temporary condition ceases and the routine is run without any negative results.

The methodology of the routine when the reverse switch point 6 is in the reverse position to generate a reverse output signal is very similar except that the controllers 24,44 both determine whether the third and fourth sensor signals indicate the reverse switch point 6 is in the reverse position, and neither the first and second sensor signals indicate the normal switch point 5 is in the normal position and compare their results to confirm they are in agreement.

It is to be understood that each of the steps described above, including the testing steps occur in fractions of a second. To maintain either a normal or reverse output signal generated by the power supplies, during a testing step, capacitors are associated with the power supplies 26*a*,26*b*,46*a*,46*b* assists in maintaining the output signals when the associated power supply or the supply of power to the power supplies is temporarily turned off due to testing of the power supplies 26*a*, 26*b*,46*a*,46*b*, proximity sensors 22*a*,22*b*,42*a*,42*b*, or microprocessors 24,44.

However, the output signal will not be generated under any of the following circumstances: a failed proximity sensor 22*a*,22*b*,42*a*,42*b* or sensor wiring, whether shorted or open; a maladjusted, misaligned, or otherwise out-of-tolerance proximity sensor 22*a*,22*b*,42*a*,42*b*; an obstacle, such as metal debris, detected between a proximity sensor 22*a* and/or 22*b* and the first stock rail 7 if the switch is in the reverse position, or between a proximity sensor 42*a* and/or 42*b* and the second stock rail 8 if the switch is in the normal position; a failed microprocessor 24,44; a switch position which is neither normal nor reverse (such as when the switch is transitioning between normal and reverse); or proximity sensors 22*a*,22*b*, 42*a*,42*b* in disagreement as to the position of the switch.

Figure 6:
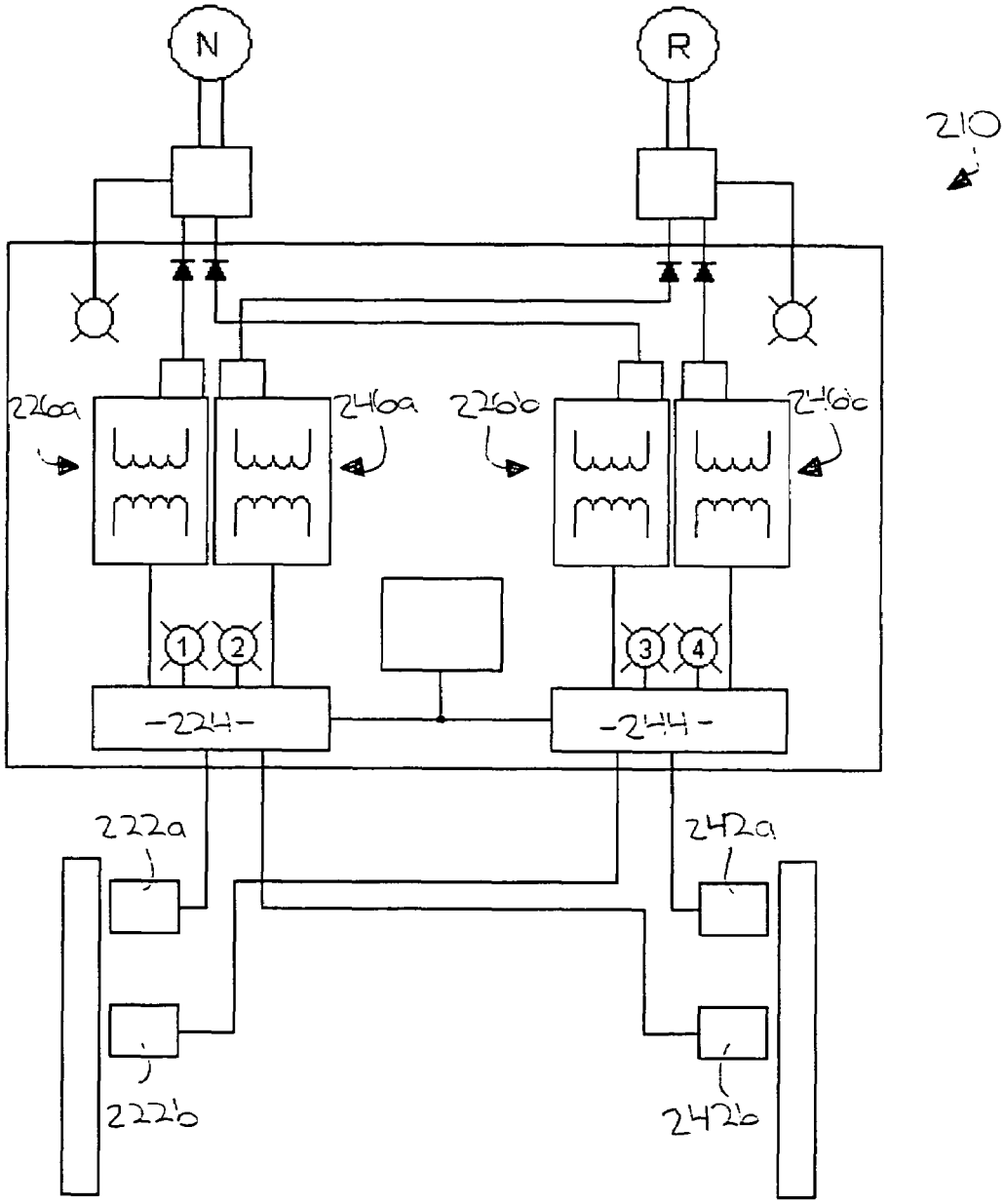
FIG. 6 is a block diagram showing major components of a preferred second embodiment of the vital proximity detection mechanism of the present invention.

FIG. 6, shows a second or alternative embodiment of the sensing mechanism 210, which operates substantially similar to the first embodiment but for the following difference. In the second embodiment, each microprocessor 224,244 independently compares the sensor signals from one proximity sensor of each pair 222*a* and 222*b* or 242*a* and 242*b* in order to confirm consistency. Thus, the first microprocessor 224 receives the sensor signals of the first and fourth proximity sensors 222*a*,242*b*, and the second microprocessor 244 receives the sensor signals from the second and third proximity sensors 222*b*,242*a*. If each microprocessor 224,244 independently confirms such consistency, the microprocessors 224,244 compare their independently-derived results with each other to further confirm consistency and proper operation of the microprocessor 224,244. If both microprocessors 224,244 agree with regard to the indicated switch position, the microprocessors 224,244 send power signals to an appropriate pair of the power supplies 226*a*,226*b*,246*a*, 246*b*. It will be appreciated that the first embodiment provides greater redundancy in checking the proximity sensors 222*a*,222*b*,242*a*,242*b* for errors, but that the second embodiment is otherwise substantially identical.

From the preceding description it will be appreciated that the mechanism and method of the present invention provide a number of substantial advantages over the prior art, including, for example, that the mechanism meets applicable AREMA safety standards and specifications for vital components and devices. Redundant proximity sensors, microprocessors, and power supplies are provided for each position to ensure reliable operation. The failure of any one of these components results in immediate detection of improper circuit operating conditions and corresponding action.

In the present invention, detection is accomplished by the dual proximity sensors located in the switch lug bracket attached to the switch points, thereby advantageously eliminating the prior art point detector linkages and contacts and the problems associated therewith. Furthermore, detection is realized from the proximity sensors located in the switch lug bracket attached to the switch points, thereby advantageously eliminating the prior art controller box and the problems associated therewith. Relatedly, the cams, contacts, and linkages within the controller box are also eliminated, and adjustment of the proximity sensors is comparatively straightforward. Additionally, the input circuits from the proximity sensors are checked for open or shorted wiring and the vital outputs are verified to follow from the inputs, thereby advantageously eliminating the prior art's potential for undetected shorted, open, or crossed wirings.

Additionally, locating the proximity sensors on the switch points provides enhanced accessibility for installation, maintenance, inspection, and adjustment. Relatedly, attaching the lugs to the switch points ensures that critical components are free from adverse environmental and operating conditions such as ice, water, snow, mud, and ballast. With further regard to installation, maintenance, inspection, and adjustment, the mechanism provides the following additional advantages: the mechanism has no moving parts that require lubrication, adjustment, or regularly scheduled maintenance; the mean time-to-failure of a typical proximity sensor is approximately twelve years, thereby minimizing down-time that might otherwise arise from replacing proximity sensors; attaching, adjusting, and unlocking the proximity sensors are all accomplished by loosening one Stage-8 locking bolt on each switch point lug, thereby minimizing the time that the track must be clear and safe to perform the adjustment; adjustment of the proximity sensor is facilitated using the handheld RSI unit that provides indications of sensor on/off status and relay position to a technician located at the proximity sensor; and the status-indicating LEDs provide quick visual indications of any malfunctions.

Although the invention has been described with reference to the preferred embodiments illustrated in the drawings, it is noted that equivalents may be employed and substitutions made herein without departing from the scope of the invention as recited in the claims.

What is claimed as new and desired to be secured by Letters Patent is as follows:

1. A method of determining and communicating whether a first member is positioned in a first alignment relative to a second member, the method comprising the steps of:

a) sensing with a first sensing device the position of the first member relative to the second member, and generating a first sensor signal corresponding thereto;

b) sensing with a second sensing device the position of the first member relative to the second member, and generating a second sensor signal corresponding thereto;

c) comparing the first and second sensor signals with a first controller device to make a first determination as to whether the first and second sensor signals both indicate that the first and second members are in the first alignment;

d) comparing the first and second sensor signals with a second controller device to make a second determination as to whether the first and second sensor signals both indicate that the first and second members are in the first alignment;

e) testing the first and second sensing devices with the first controller to make a third determination that the first and second sensing devices are functioning properly;

f) testing the first and second sensors with the second controller to make a fourth determination that the first and second sensors are functioning properly;

g) causing a first changing DC power signal to be provided to a first power supply if a first set of selected conditions are satisfied including confirmation from the first determination that the first and second sensor signals both indicate that the first and second members are in the first alignment and the second determination is not inconsistent with the first determination and confirmation from the third determination that the first and second sensors are functioning properly and the fourth determination is not inconsistent with the third determination;

h) causing a second changing DC power signal to be provided to a second power supply if a second set of selected conditions are satisfied including confirmation from the second determination that the first and second sensor signals both indicate that the first and second members are in the first alignment and the first determination is not inconsistent with the second determination and confirmation from the fourth determination that the first and second sensors are functioning properly and the third determination is not inconsistent with the fourth determination;

i) converting the first changing DC power signal to a first AC power signal, and then converting the first AC power signal to a first non-changing DC power signal; and j) converting the second changing DC power signal to a second AC power signal, and then converting the second AC power signal to a second non-changing DC power signal.

2. The method of claim 1 further comprising the step of using at least one of the first and second DC output signals with a signal controller to cause a signaling device to indicate that the first and second members are in the first alignment.

3. The method as set forth in claim 1, further including the step of communicating visually a status of the first and second sensing devices.

4. The method as set forth in claim 1, further including the step of transmitting via an RF signal data indicative of statuses of the first and second sensing devices.

5. The method as set forth in claim 4, further including the step of receiving and communicating to a user the data transmitted by the RF transmitter, thereby facilitating adjustment of the first and second sensing devices.

* * * * *